US010839824B2

(12) United States Patent
Hasegawa

(10) Patent No.: US 10,839,824 B2
(45) Date of Patent: Nov. 17, 2020

(54) AUDIO DEVICE, MISSING BAND ESTIMATION DEVICE, SIGNAL PROCESSING METHOD, AND FREQUENCY BAND ESTIMATION DEVICE

(71) Applicant: PIONEER CORPORATION, Tokyo (JP)

(72) Inventor: Shin Hasegawa, Saitama (JP)

(73) Assignee: PIONEER CORPORATION, Tokyo (JP)

( * ) Notice: Subject to any disclaimer, the term of this patent is extended or adjusted under 35 U.S.C. 154(b) by 60 days.

(21) Appl. No.: 15/128,607

(22) PCT Filed: Mar. 27, 2014

(86) PCT No.: PCT/JP2014/058859
§ 371 (c)(1),
(2) Date: Sep. 23, 2016

(87) PCT Pub. No.: WO2015/145660
PCT Pub. Date: Oct. 1, 2015

(65) Prior Publication Data

US 2017/0103772 A1 Apr. 13, 2017

(51) Int. Cl.
*G10L 21/038* (2013.01)
*G10L 19/26* (2013.01)
*G10L 25/21* (2013.01)

(52) U.S. Cl.
CPC ..... *G10L 21/038* (2013.01); *G10L 19/26* (2013.01); *G10L 25/21* (2013.01)

(58) Field of Classification Search
None
See application file for complete search history.

(56) References Cited

U.S. PATENT DOCUMENTS

2010/0145685 A1* 6/2010 Nilsson ..... G10L 21/038 704/205
2010/0223052 A1* 9/2010 Nilsson ..... G10L 21/038 704/205

(Continued)

FOREIGN PATENT DOCUMENTS

JP 2004-317622 11/2004
JP 2007-192964 8/2007

(Continued)

OTHER PUBLICATIONS

International Search Report, PCT/JP2014/058859, dated May 27, 2014.

*Primary Examiner* — Richa Mishra
(74) *Attorney, Agent, or Firm* — Nixon & Vanderhye

(57) ABSTRACT

During high-frequency interpolation, a harmonic generation unit first generates a harmonic signal for an input compressed audio signal. An HPF unit, having a cutoff frequency, extracts a high frequency component from the compressed audio signal in parallel with the generation of the harmonic signal. An HPF unit, having a cutoff frequency, extracts a high frequency component from the compressed audio signal. An estimation unit estimates a missing band in the compressed audio signal on the basis of a ratio of the signal level of a difference signal to the signal level of an output signal, the difference signal being obtained by subtracting the output signal of the HPF unit from the output signal of the HPF unit. The estimation unit controls the cutoff frequency of a variable HPF unit that extracts a signal component for high-frequency interpolation from the harmonic signal on the basis of the estimated missing band.

6 Claims, 7 Drawing Sheets

(56) References Cited

U.S. PATENT DOCUMENTS

| | | | | |
|---|---|---|---|---|
| 2012/0275607 | A1 | 11/2012 | Kjoerling et al. | |
| 2013/0163784 | A1* | 6/2013 | Tracey | H03G 3/00 381/103 |
| 2015/0030181 | A1* | 1/2015 | Kimura | H04R 3/04 381/94.3 |
| 2015/0051905 | A1* | 2/2015 | Gao | G10L 19/125 704/207 |

FOREIGN PATENT DOCUMENTS

| | | |
|---|---|---|
| JP | 2011-203480 | 10/2011 |
| JP | 2013-511752 | 4/2013 |

* cited by examiner (A)

[Filtering Characteristic of HPF Unit $121_1$]

(B)

[Filtering Characteristic of HPF Unit $121_2$]

AUDIO DEVICE, MISSING BAND ESTIMATION DEVICE, SIGNAL PROCESSING METHOD, AND FREQUENCY BAND ESTIMATION DEVICE

TECHNICAL FIELD

The present invention relates to an audio device, to a missing band estimation device, to a signal processing method, to a signal processing program, and to a recording medium upon which the signal processing program is recorded, and to a frequency band estimation device.

BACKGROUND ART

In recent years, audio devices that replay sound contents recorded in digital format have become widespread. In many cases, in order to reduce the file size, the data for the sound contents is subjected to digital compression processing according to a method such as MP3 (MPEG (Moving Picture Expert Group) Audio Layer-3) or the like. The compressed audio signal that is obtained by decompressing compressed audio data that has been generated by performing the digital compression processing becomes an audio signal in which the high frequency band is more limited than the band that is limited by the sampling frequency ($F_S$) that was employed when obtaining the original audio data before compression processing. And, if compression processing according to the same method is performed upon the high frequency band that is thus limited by the compression processing according to the bit rate of the decompressed signal, then, the lower the bit rate becomes (in other words, the higher the compression ratio becomes), the wider that high frequency band becomes.

Due to this, a technique has been proposed (refer to Patent Document #1, hereinafter termed the "prior art") for interpolating the high frequency band that lacks the signal component originating due to compression processing, according to the bit rate, in other words according to the compression ratio. In the prior art technique, a discriminating means reads in information including bit rate and so on that is separate from the compressed audio signal obtained by decompressing the compressed audio data. Subsequently, on the basis of the information including bit rate and so on that has been read in, the discriminating means sets a cutoff frequency of a high pass filter that passes a harmonic signal generated by a harmonic generation means. And, the signal component of the high frequency band is interpolated by the signal that has passed through the high pass filter whose cutoff frequency has been set in this manner being combined with the compressed audio signal.

PRIOR ART DOCUMENT

Patent Documents

Patent Document #1: Japanese Laid-Open Patent Publication 2004-317622

SUMMARY OF THE INVENTION

Problem to be Solved by the Invention

With the technique of the prior art example described above, since the discriminating means appropriately sets the cutoff frequency of the high pass filter that performs high pass filtering processing upon the harmonic signal generated by the harmonic generation means, accordingly information about bit rate and so on separated from the compressed audio data is read in. In other words, with the technique of the prior art example, the discriminating means is adapted to be able to access a storage device in which the compressed audio data and information such as the bit rate and so on are stored.

However, in recent years, it is often the case that such compressed audio data and information about bit rate and so on are downloaded as sound contents from a server upon a network by a compact portable terminal device. Due to this, in some cases, the compressed audio signal that is generated by the compact portable terminal device is sent to some other audio device, and is outputted as audio sound after having been converted into a high quality audio signal in which high frequency band interpolation has been performed by that audio device.

In such a case, if the technique of the prior art example is applied, it becomes necessary to transmit the information such as the bit rate and so on from the portable terminal device to the other audio device via a path that is different from the path of the compressed audio signal. Accordingly additional functionality in the portable terminal device is required, so that it is difficult to say that it is possible to output high quality audio sound in which interpolation of the high frequency band has been performed with a simple configuration.

Due to this, there has been a demand for a technique that can output audio sound of high quality by performing high frequency band interpolation with a simple configuration. Responding to this requirement is cited as one problem that the present invention can solve.

Means for Solving the Problems

When considered from a first standpoint, the present invention is an audio device comprising: a harmonic generation unit that generates harmonics of an audio signal that is inputted; a variable high pass filter unit having variable cutoff frequency, that extracts a high frequency component of said harmonics generated by said harmonic generation unit; a first high pass filter unit having a first cutoff frequency, that extracts a high frequency component of said inputted audio signal; a second high pass filter unit having a second cutoff frequency that is higher than said first cutoff frequency, that extracts a high frequency component of said inputted audio signal; and a control unit that controls the cutoff frequency of said variable high pass filter unit on the basis of level of an output signal extracted with said first high pass filter unit and level of an output signal extracted with said second high pass filter unit.

And, when considered from a second standpoint, the present invention is a missing band estimation device comprising: a first high pass filter unit having a first cutoff frequency, that extracts a high frequency component of an audio signal that is inputted; a second high pass filter unit having a second cutoff frequency that is higher than said first cutoff frequency, that extracts a high frequency component of said audio inputted signal; and an estimation unit that estimates a high frequency band for which signal components in said inputted audio signal is missing, on the basis of level of an output signal extracted with said first high pass filter unit and level of an output signal extracted with said second high pass filter unit.

And, when considered from a third standpoint, the present invention is a signal processing method employed in an audio device comprising: a harmonic generation unit that generates harmonics of an audio signal that is inputted; a variable high pass filter unit having variable cutoff frequency, that extracts a high frequency component of said harmonics generated by said harmonic generation unit; a first high pass filter unit having a first cutoff frequency and that extracts a high frequency component of said inputted audio signal; and a second high pass filter unit having a second cutoff frequency that is higher than said first cutoff frequency and that extracts a high frequency component of said inputted audio signal, the signal processing method comprising the steps of: acquiring level of an output signal extracted with said first high pass filter unit and level of an output signal extracted with said second high pass filter unit; and controlling the cutoff frequency of said variable high pass filter unit on the basis of the results of acquisition by said acquiring step.

And, when considered from a fourth standpoint, the present invention is a signal processing program, wherein it causes a computer in an audio device to execute a signal processing method according to the present invention.

And, when considered from a fifth standpoint, the present invention is a recording medium, wherein a signal processing program according to the present invention is recorded thereon in a form that can be read by a computer in an audio device.

And, when considered from a sixth standpoint, the present invention is a frequency band estimation device comprising: a first high pass filter unit having a first cutoff frequency, that extracts a high frequency component of said inputted audio signal; a second high pass filter unit having a second cutoff frequency that is higher than said first cutoff frequency, that extracts a high frequency component of said inputted audio signal; and an estimation unit that estimates a high frequency band of said inputted audio signal, on the basis of level of an output signal extracted with said first high pass filter unit and level of an output signal extracted with said second high pass filter unit.

REFERENCE SIGNS LIST

Figure 1:
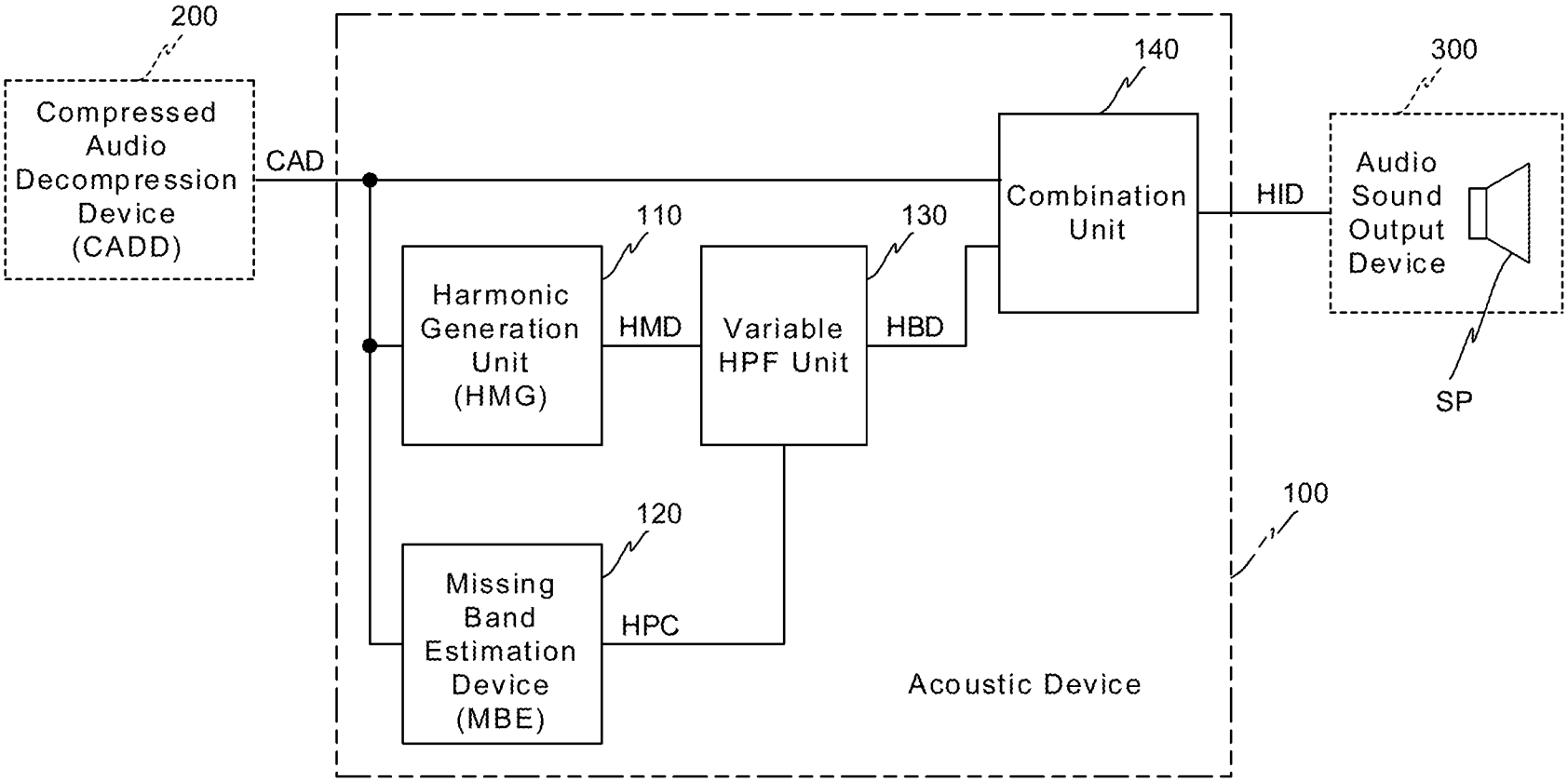
FIG. 1 is a block diagram schematically showing the configuration of an audio device according to an embodiment of the present invention.
Figure 2:
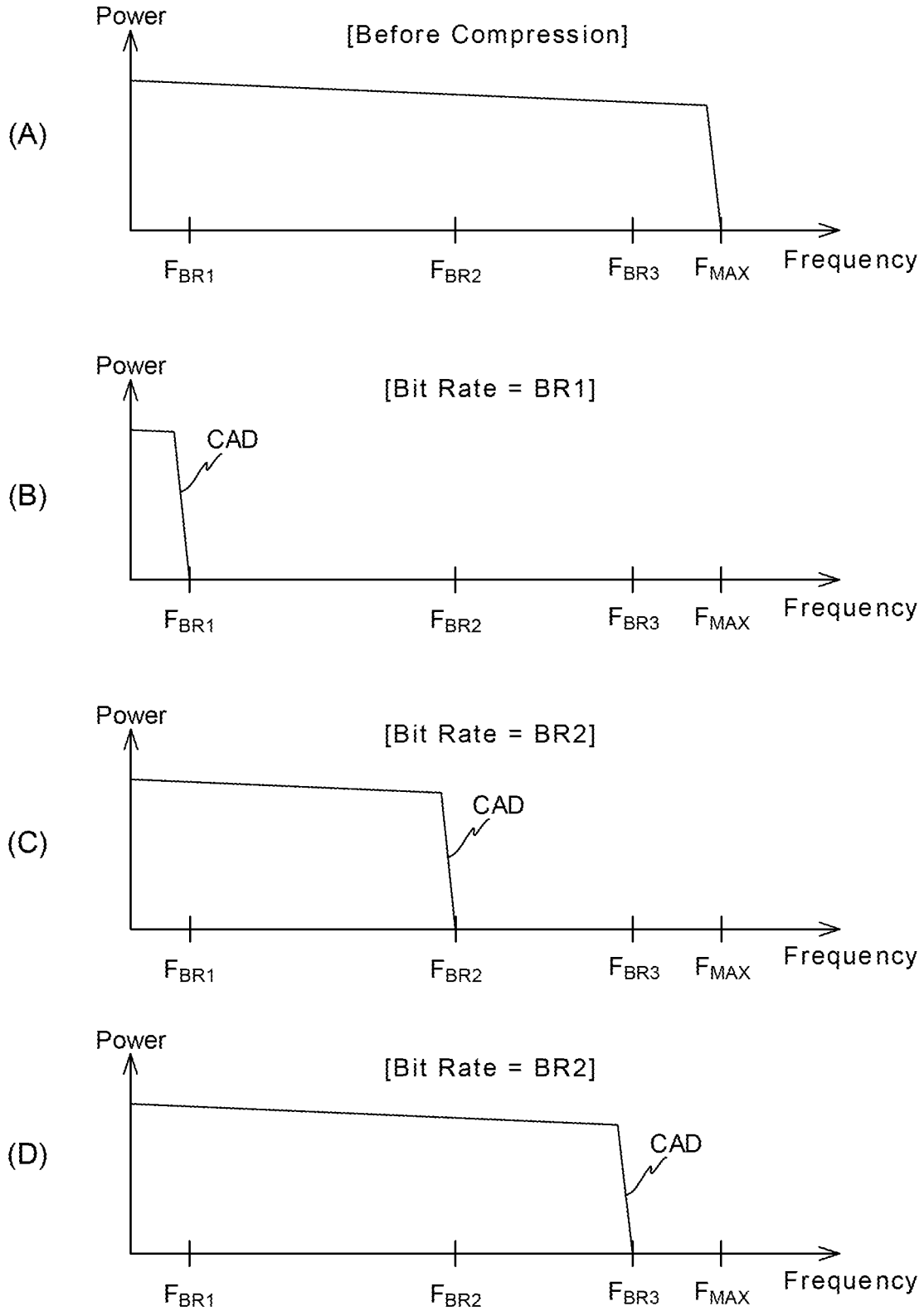
FIG. 2 is a figure showing average spectrums of compressed audio signals that are inputted to the audio device of FIG. 1 at various bit rates.

100: audio device
110: harmonic generation unit
120: missing band estimation device (frequency band estimation device)
$121_1$: high pass filter (first high pass filter)
$121_2$: high pass filter (second high pass filter)
124: estimation unit (control unit)
130: variable high pass filter unit
140: combination unit

EMBODIMENTS FOR CARRYING OUT THE INVENTION

In the following, an embodiment of the present invention will be explained with reference to FIGS. 1 through 7. Note that, in the drawings, the same reference symbols are appended to elements that are the same or equivalent, and duplicated explanation will be omitted.

[Configuration]

The schematic configuration of an audio device 100 according to the embodiment of the present invention is shown in FIG. 1 as a block diagram. As shown in FIG. 1, the audio device 100 is connected to a compressed audio decompression device 200 and to an audio sound output device 300.

Here, the compressed audio decompression device 200 decompresses compressed audio data that has been generated in conformity with a predetermined standard, such as the MP3 standard or the like, and generates a compressed audio signal CAD (i.e. an audio signal). The compressed audio signal CAD that has been generated in this manner is sent to the audio device 100.

Note that, in the embodiment, the compressed audio signal CAD is a compressed audio signal corresponding to any of the three bit rates "BR1", "BR2 (>BR1)", and "BR3 (>BR2)".

Moreover, the audio sound output device 300 comprises a speaker SP. The audio sound output device 300 receives a signal HID after high frequency interpolation sent from the audio device 100. And, the audio sound output device 300 outputs sound from the speaker SP corresponding to the signal HID after high frequency interpolation.

<Configuration of the Audio Device 100>

The audio device 100 comprises a harmonic generation unit (HMG) 110 and a missing band estimation device (MBE) 120. Moreover, the audio device 100 comprises a variable high pass filter (HPF) unit 130 and a combination unit 140.

The harmonic generation unit 110 receives the compressed audio signal CAD sent from the compressed audio decompression device 200. Subsequently, the harmonic generation unit 110 generates the first through the N-th order harmonic components of predetermined frequency bands (0 through $F_H$) of the compressed audio signal CAD. And, among these harmonics that have been generated, the components that are less than or equal to the highest frequency $F_{MAX}$ ($=F_S/2$) of the audio band before compression determined by the sampling frequency $F_S$ are sent to the variable HPF unit 130 as a signal HMD.

The missing band estimation device 210 receives the compressed audio signal CAD sent from the compressed audio decompression device 200. Subsequently, on the basis of the compressed audio signal CAD, the missing band estimation device 200 estimates a high frequency band (hereinafter sometimes termed the "missing band") for which a signal component is missing in the compressed audio signal CAD. And, the missing band estimation device 120 sends a cutoff frequency designator HPC that designates the lowest frequency of that estimated missing band to the variable HPF unit 130.

Here, estimating the missing band in the compressed audio signal CAD is the same thing as estimating the frequency band of the compressed audio signal CAD. Due to this, the missing band estimation device 120 also has a function of serving as a frequency band estimation device that estimates the frequency band of the compressed audio signal CAD.

Note that the details of the configuration of the missing band estimation device 120 will be described hereinafter.

The variable HPF unit 130 receives the signal HMD sent from the harmonic generation unit 110. Moreover, the variable HPF unit 130 receives the cutoff frequency designator HPC sent from the missing band estimation device 120. And, the variable HPF unit 130 performs high pass filtering processing upon the signal HMD while taking the frequency designated by the cutoff frequency designator HPC as cutoff frequency. The result of the high pass filtering processing is sent to the combination unit 140 as a signal HBD.

The combination unit 140 receives the compressed audio signal CAD sent from the compressed audio decompression device 200. Moreover, the combination unit 140 also receives the signal HBD sent from the variable HPF unit 130. And, the combination unit 140 performs combination upon the compressed audio signal CAD and the signal HBD, thereby generating a signal HID after high frequency interpolation. The signal HID that has been generated after high frequency interpolation in this manner is sent to the audio sound output device 300.

Note that the details of the configuration of the combination unit 140 will be described hereinafter.

Now, the relationship between the bit rate and the compressed audio band will be explained. The average spectrum of the audio sound before compression, which corresponds to digital musical sound that has been generated by sampling at the sampling frequency $F_S$, is schematically shown in FIG. 2(A). As shown in FIG. 2(A), the upper limit frequency of the band of the audio sound before compression is the highest frequency $F_{MAX}$ ($=F_S/2$).

The signal bands of the compressed audio signals obtained by decompressing compressed audio data having the bit rates BR1 through BR3 described above and obtained by compressing the audio data before compression are shown in FIGS. 2(B) through 2(D). Here, the signal band of the audio sound that has been compressed at the bit rate BR1 is shown in FIG. 2(B). As shown in FIG. 2(B), the upper limit frequency of the signal band of the audio sound compressed at the bit rate BR1 is the frequency $F_{BR1}$, and the frequency band ($F_{BR1}$ to $F_{MAX}$) becomes a missing band signal component, as compared to the audio sound before compression.

Moreover, the signal band of the audio sound that has been compressed at the bit rate BR2 (>BR1) is shown in FIG. 2(C). As shown in FIG. 2(C), the upper limit frequency of the signal band of the audio sound compressed at the bit rate BR2 is the frequency $F_{BR2}$ ($>F_{BR1}$), and the frequency band ($F_{BR2}$ to $F_{MAX}$) becomes a missing band signal component, as compared to the audio sound before compression.

Yet further, the signal band of the audio sound that has been compressed at the bit rate BR3 (>BR2) is shown in FIG. 2(D). As shown in FIG. 2(D), the upper limit frequency of the signal band of the audio sound compressed at the bit rate BR3 is the frequency $F_{BR3}$ ($>F_{BR2}$), and the frequency band ($F_{BR3}$ to $F_{MAX}$) becomes a missing band signal component, as compared to the audio sound before compression.

(The Configuration of the Missing Band Estimation Device 120)

Next, the configuration of the missing band estimation device 120 will be explained.

Figure 3:
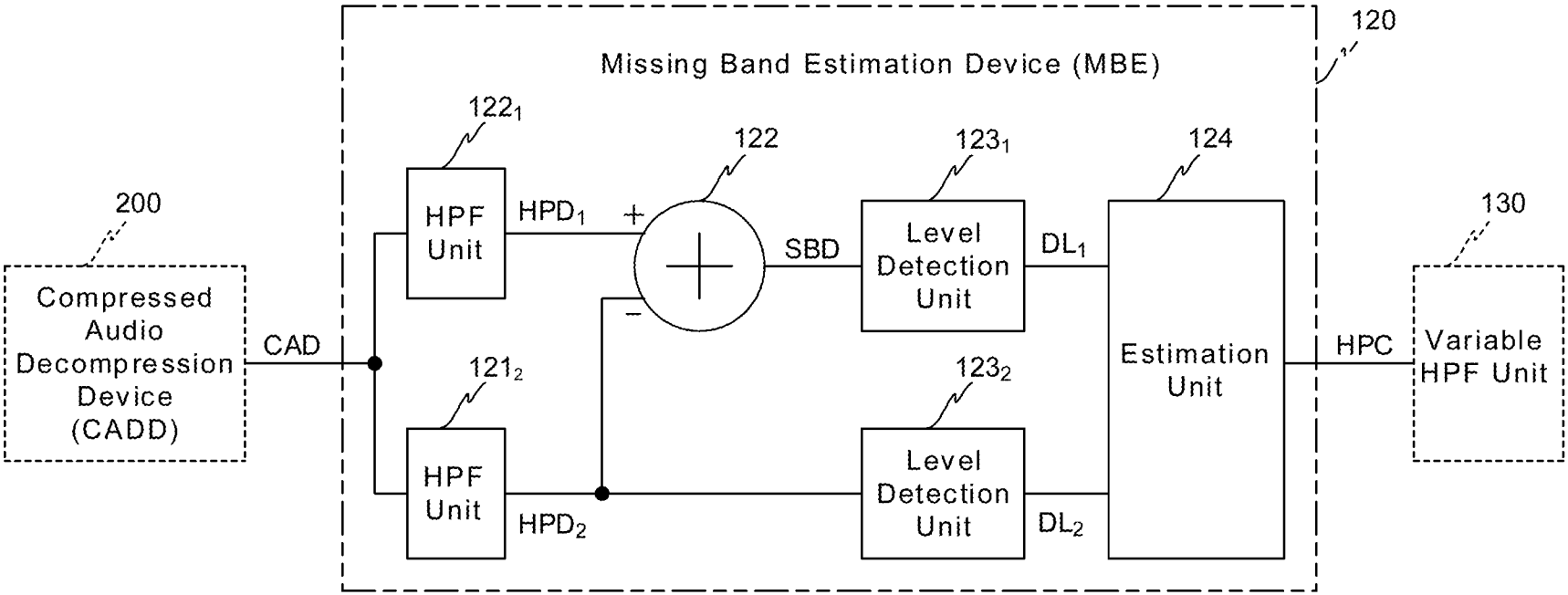
FIG. 3 is a block diagram showing the configuration of a missing band estimation device of FIG. 1.

As shown in FIG. 3, the missing band estimation device 120 comprises bypass filters (HPF) units $\mathbf{121}_1$ and $\mathbf{121}_2$ and a subtraction unit 122. Moreover, the missing band estimation device 120 comprises level detection units $\mathbf{123}_1$ and $\mathbf{123}_2$ and an estimation unit 124.

The HPF unit $\mathbf{121}_1$ performs high pass filtering processing with a cutoff frequency $F_{C1}$. The HPF unit $\mathbf{121}_1$ receives the compressed audio signal CAD sent from the compressed audio decompression device 200. And, the HPF unit $\mathbf{121}_1$ performs high pass filtering processing upon the compressed audio signal CAD with the cutoff frequency $F_{C1}$. The result of the high pass filtering processing is sent to the subtraction unit 122 as a signal $HPD_1$.

The HPF unit $\mathbf{121}_2$ performs high pass filtering processing with a cutoff frequency $F_{C2}$ ($>F_{C1}$). The HPF unit $\mathbf{121}_2$ receives the compressed audio signal CAD sent from the compressed audio decompression device 200. And, the HPF unit $\mathbf{121}_2$ performs high pass filtering processing upon the compressed audio signal CAD with the cutoff frequency $F_{C2}$. The result of the high pass filtering processing is sent to the subtraction unit 122 and to the level detection unit $\mathbf{123}_2$ as a signal $HPD_2$.

The subtraction unit 122 receives the signal $HPD_1$ sent from the HPF unit $\mathbf{121}_1$. Furthermore, the subtraction unit 122 receives the signal $HPD_2$ sent from the HPF unit $\mathbf{121}_2$. And, the subtraction unit 122 subtracts the signal $HPD_2$ from the signal $HPD_1$. The result calculated in this manner is sent to the level detection unit $\mathbf{123}_1$ as a signal SBD.

The level detection unit $\mathbf{123}_1$ receives the signal SBD sent from the subtraction unit 122. And, the level detection unit $\mathbf{123}_1$ detects the power level of the signal SBD. The result of detection by the level detection unit $\mathbf{123}_1$ is sent to the estimation unit 124 as a detection level $DL_1$.

The level detection unit $\mathbf{123}_2$ receives the signal $HPD_2$ sent from the HPF unit $\mathbf{121}_2$. And, the level detection unit $\mathbf{123}_2$ detects the power level of the signal $HPD_2$. The result of detection by the level detection unit $\mathbf{123}_2$ is sent to the estimation unit 124 as a detection level $DL_2$.

The estimation unit 124 receives the detection level $DL_1$ sent from the level detection unit $\mathbf{123}_1$. Moreover, the estimation unit 124 receives the detection level $DL_2$ sent from the level detection unit $\mathbf{123}_2$. And, the estimation unit 124 estimates the missing band in the compressed audio signal CAD on the basis of the ratio R ($=DL_1/DL_2$) between the detection level $DL_1$ and the detection level $DL_2$.

Subsequently, the estimation unit 124 generates a cutoff frequency designator HPC that designates the lower limit frequency of the estimated missing band. The cutoff frequency designator HPC that has been designated in this manner is sent to the variable HPF unit 130.

Figure 4:
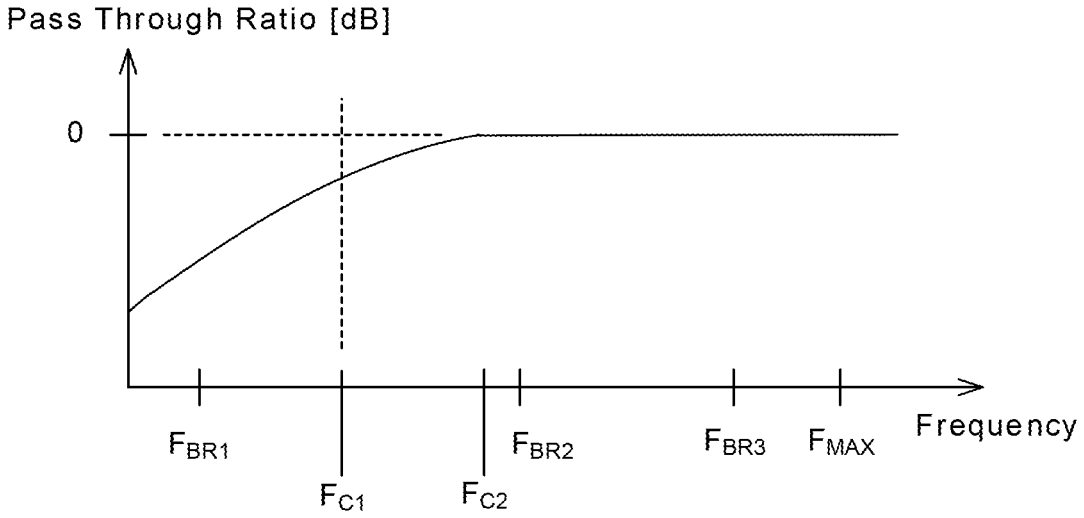
FIG. 4 is a figure for explanation of the filtering characteristics of two high pass filter (HPF) units of FIG. 3.
Figure 4:
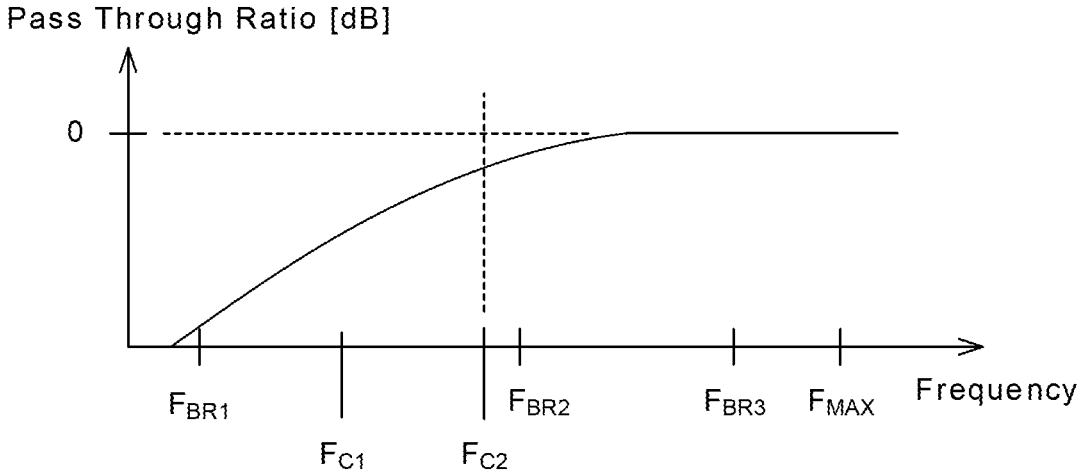

Note that examples of the filtering characteristics of the HPF unit $\mathbf{121}_1$ and of the HPF unit $\mathbf{121}_2$ are shown in FIG. 4. Here, an example of the filtering characteristic of the HPF unit $\mathbf{121}_1$ is shown in FIG. 4(A). Moreover, an example of the filtering characteristic of the HPF unit $\mathbf{121}_2$ is shown in FIG. 4(B).

Here, for each of the bit rates BR1, BR2, and BR3, the filtering characteristic of the HPF unit $\mathbf{121}_2$ is set so that, when the ratio R is calculated, overflow of the division resource of the estimation unit 124 does not occur.

Figure 5:
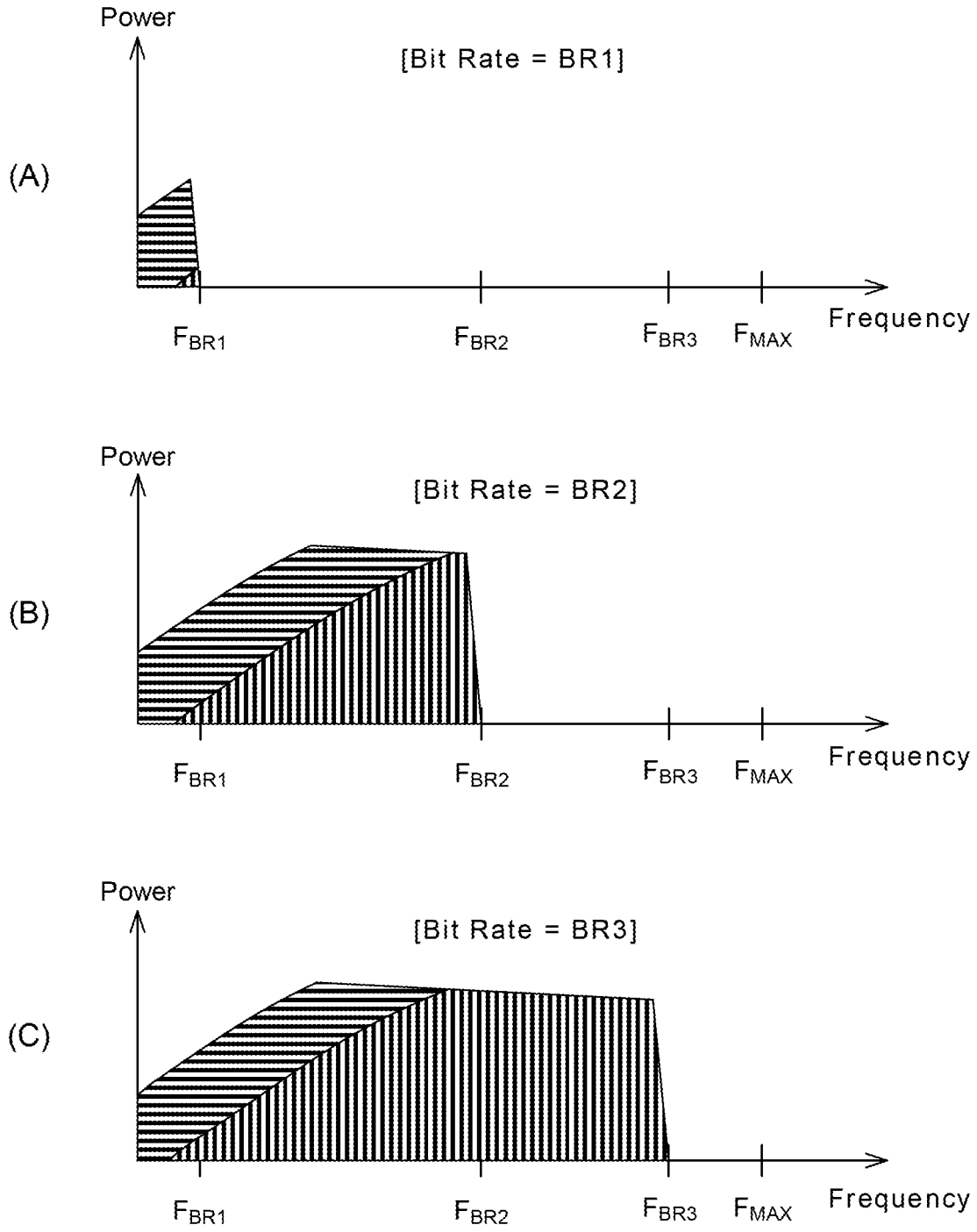
FIG. 5 is a figure for explanation of the signal components corresponding to the subjects of detection by the two level detection units of FIG. 3, for each of three bit rates.

Moreover, the signal components corresponding to the subjects of detection by the HPF unit $\mathbf{121}_1$ and the HPF unit $\mathbf{121}_2$ are schematically shown in FIG. 5. Note that, in FIG. 5, along with the signal component corresponding to the subject of detection by the HPF unit $\mathbf{121}_1$ being shown by horizontal line hatching, also the signal component corresponding to the subject of detection by the HPF unit $\mathbf{121}_2$ is shown by vertical line hatching.

Here, for the case of the bit rate BR1, the signal components corresponding to the subjects of detection by the HPF unit $121_1$ and by the HPF unit $121_2$ are schematically shown in FIG. 5(A). And, for the case of the bit rate BR2, the signal components corresponding to the subjects of detection by the HPF unit $121_1$ and by the HPF unit $121_2$ are schematically shown in FIG. 5(B). Moreover, for the case of the bit rate BR3, the signal components corresponding to the subjects of detection by the HPF unit $121_1$ and by the HPF unit $121_2$ are schematically shown in FIG. 5(C).

As will be understood by comparison between FIGS. 5(A) through 5(C), when the bit rate is different, the calculated ratios R also become different. Due to this, the estimation unit 124 is able to estimate the bit rate of the compressed audio signal CAD when the missing band is uniquely determined with respect to the bit rate, since it is possible to estimate the missing region in the compressed audio signal CAD on the basis of the value of the ratio R that has been calculated.

(The Configuration of the Combination Unit 140)

Next, the configuration of the combination unit 140 will be explained.

Figure 6:
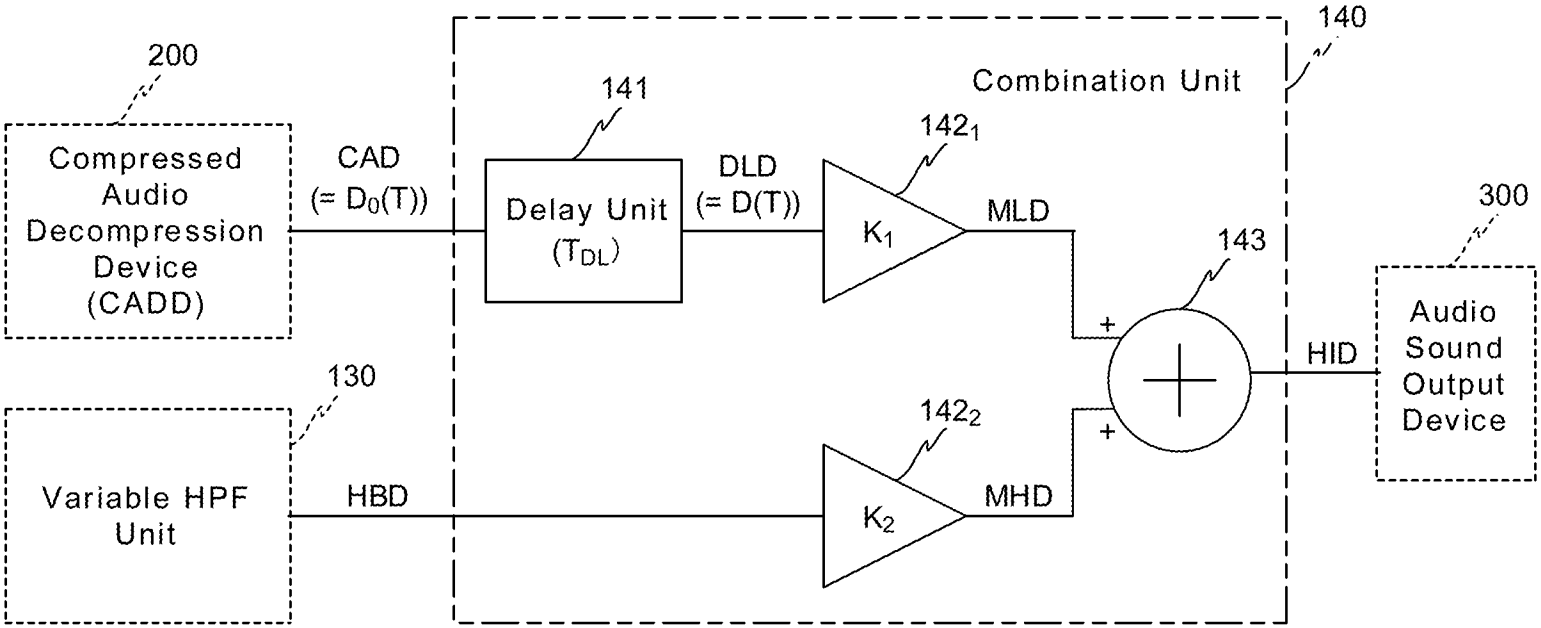
FIG. 6 is a block diagram for explanation of the configuration of a combination unit of FIG. 1.

As shown in FIG. 6, the combination unit 140 comprises a delay unit 141 and multiplication units $142_1$ and $142_2$. Moreover, the combination unit 140 comprises an addition unit 143.

The delay unit 141 receives the compressed audio signal CAD sent from the compressed audio decompression device 200 (=$D_0$(T), where T is time). And, the delay unit 141 generates a signal DLD (=D(T)) by delaying the compressed audio signal CAD by just a time interval $T_{DL}$ that corresponds to the phase delay in the harmonic generation unit 110 and the variable HPF unit 130. Here, the relationship between the signal D(T) and the compressed audio signal $D_0$(T) is given by the following Equation (1):

$$D(T)=D_0(T-T_{DL}) \quad (1)$$

The result is that the synchronization between the signal DLD and the signal HBD outputted from the variable HPF unit 130 becomes as planned. The DLD signal that has been generated in this manner is sent to the multiplication unit $142_1$.

The multiplication unit $142_1$ receives the signal DLD sent from the delay unit 141. And, the multiplication unit $142_1$ multiplies the signal DLD by $K_1$, thus generating a signal MLD. The signal MLD that has been generated in this manner is sent to the addition unit 143.

The multiplication unit $142_2$ receives the signal HBD sent from the variable HPF unit 130. And, the multiplication unit $142_2$ multiplies the signal HBD by $K_2$, thus generating a signal MHD. The signal MHD that has been generated in this manner is sent to the addition unit 143.

Note that the ratio between the value $K_1$ and the value $K_2$ is determined in advance on the basis of experiment, simulation, experience and so on, from the standpoint of appropriate high frequency interpolation.

The addition unit 143 receives the signal MLD sent from the multiplication unit $142_1$. Moreover, the addition unit 143 receives the signal MHD sent from the multiplication unit $142_2$. And, the addition unit 143 generates a signal HID after high frequency interpolation by adding together the signal MLD and the signal MHD. The signal HID after high frequency interpolation that has been generated in this manner is sent to the audio sound output device 300.

Figure 7:
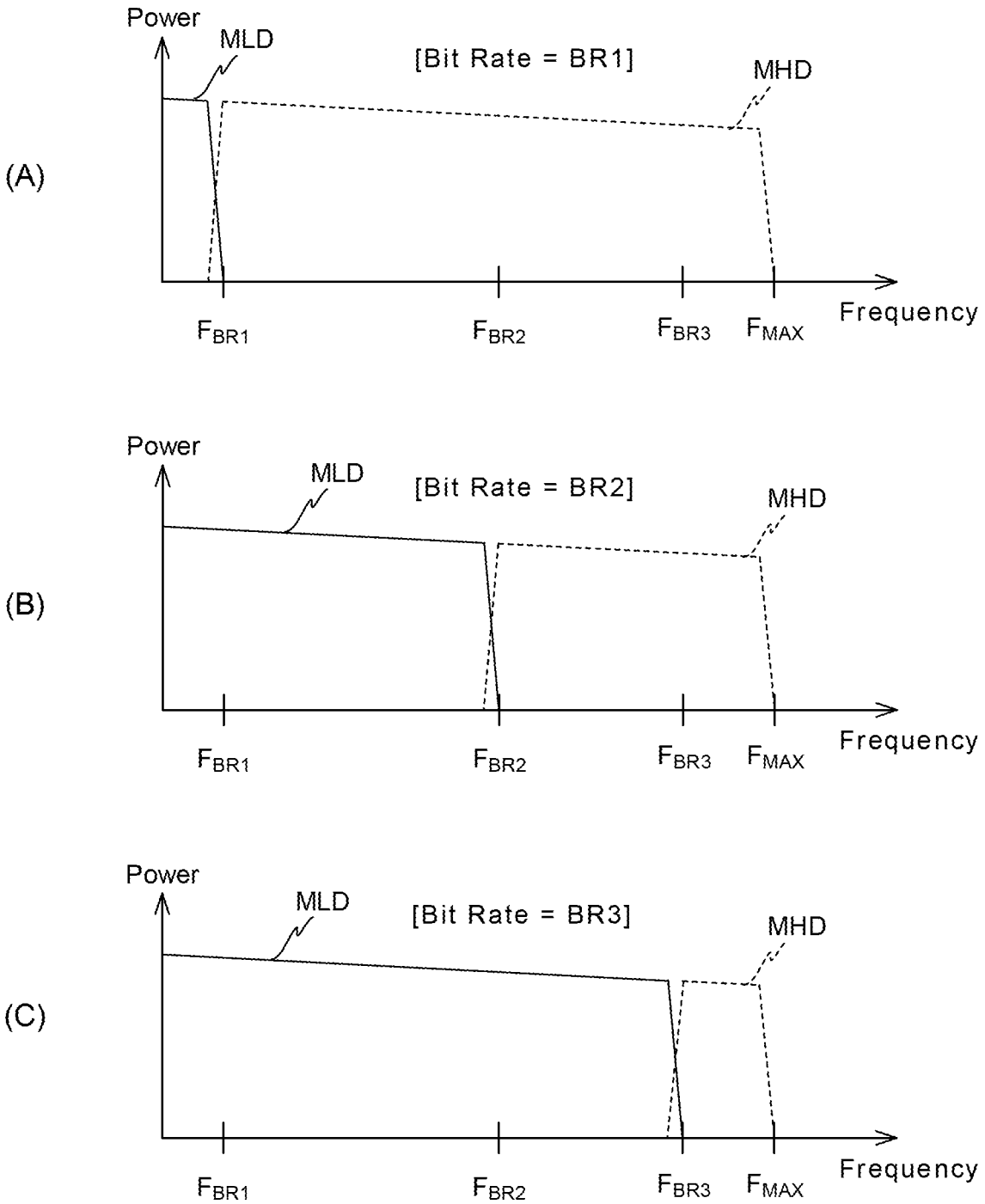
FIG. 7 is a figure for explanation of high frequency interpolation by the device of FIG. 1.

Spectrums of signals MHD that have been generated in this manner are shown in FIG. 7. Here, the spectrum of a signal MHD that has been generated corresponding to a compressed audio signal at the bit rate BR1 is shown by the broken line in FIG. 7(A). Moreover, the spectrum of a signal MHD that has been generated corresponding to a compressed audio signal at the bit rate BR2 is shown by the broken line in FIG. 7(B). And, the spectrum of a signal MHD that has been generated corresponding to a compressed audio signal at the bit rate BR3 is shown by the broken line in FIG. 7(C). Note that, in FIGS. 7(A) through 7(C), the spectrums of the signals MLD that are $K_1$ times the signals DLD (and, furthermore, of the signals that are $K_1$ times the compressed audio signals CAD) are shown by the solid lines.

As shown in FIGS. 7(A) through 7(C), the signal HMD becomes a signal in which the missing band of a signal component in the compressed audio signal CAD is interpolated in an appropriate manner.

[Operation]

Next, the operation of the audio device 100 having the configuration as described above will be explained, with attention principally being focused upon the processing for generation of the signal HBD on the basis of the compressed audio signal CAD (refer to FIG. 1).

When the compressed audio decompression device 200 starts supply of the compressed audio signal CAD, in the audio device 100, the harmonic generation unit 110 and the missing band estimation device 120 receive the compressed audio signal CAD. Moreover, in the audio device 100, the combination unit 140 receives the compressed audio signal CAD (refer to FIG. 1).

Upon receipt of the compressed audio signal CAD, the harmonic generation unit 110 generates harmonics of components of a predetermined frequency band of the compressed audio signal CAD. And, among the harmonics that are generated, the harmonic generation unit 110 sends the components at less than the highest frequency $F_{MAX}$ of the band of the audio sound before compression determined by the sampling frequency $F_S$ to the variable HPF unit 130 (refer to FIG. 1) as the signal HMD.

On the other hand, upon receipt of the compressed audio signal, the estimation device 120, in parallel with the high frequency generation by the harmonic generation unit 110, also, on the basis of the compressed audio signal CAD, estimates the missing band in the compressed audio signal CAD. During the estimation of the missing band, in the missing band estimation device 120, the HPF unit $121_1$ that has received the compressed audio signal CAD performs high pass filtering processing at the cutoff frequency $F_{C1}$ upon the compressed audio signal CAD. And, the HPF unit $121_1$ sends the result of the high pass filtering processing to the subtraction unit 122 as the signal $HPD_1$ (refer to FIG. 3).

Furthermore, upon receipt of the compressed audio signal CAD, in parallel with the high pass filtering processing performed by the HPF unit $121_1$, the HPF unit $121_2$ performs high pass filtering processing with the cutoff frequency $F_{C2}$ upon the compressed audio signal CAD. And, the HPF unit $121_2$ sends the result of the high pass filtering processing to the subtraction unit 122 and to the level detection unit $123_2$ as the signal $HPD_2$ (refer to FIG. 3).

Upon receipt of the signal $HPD_1$ sent from the HPF unit $121_1$ and of the signal $HPD_2$ sent from the HPF unit $121_2$, the subtraction unit 122 calculates the difference between the signal $HPD_1$ and the signal $HPD_2$. And, the subtraction unit 122 sends the differential that it has calculated to the level detection unit $123_1$ as a signal SBD (refer to FIG. 3).

Upon receipt of the signal SBD sent from the subtraction unit 122, the level detection unit $123_1$ detects the power level of the signal SBD. And, the level detection unit $123_1$ sends the result of the detection to the estimation unit 124 as a detection level $DL_1$ (refer to FIG. 3).

Upon receipt of the signal $HPD_2$ sent from the HPF unit $121_2$, the level detection unit $123_2$ detects the power level of the signal $HPD_2$. And, the level detection unit $123_2$ sends the result of the detection to the estimation unit 124 as a detection level $DL_2$ (refer to FIG. 3).

Upon receipt of the detection level $DL_1$ sent from the level detection unit $123_1$ and of the detection level $DL_2$ sent from the level detection unit $123_2$, the estimation unit 124 generates a cutoff frequency designator HPC on the basis of the detection level $DL_1$ and the detection level $DL_2$. And, when generating the cutoff frequency designator HPC, the estimation unit 124 first calculates the ratio R ($=DL_1/DL_2$) between the detection level $DL_1$ and the detection level $DL_2$.

Subsequently, the estimation unit 124 estimates the missing band of the compressed audio signal on the basis of the ratio R that has been calculated.

Next, the estimation unit 124 generates the cutoff frequency designator HPC that specifies the lower limit frequency of the missing band that has been estimated. And, the estimation unit 124 sends the cutoff frequency designator HPC that it has generated to the variable HPF unit 130 (refer to FIG. 3).

Upon receipt of the cutoff frequency designator HPC sent from the missing band estimation device 120 (more exactly, from the estimation unit 124), the variable HPF unit 130 performs high pass filtering processing with the frequency designated by the cutoff frequency designator HPC as the cutoff frequency upon the signal HMD sent from the harmonic generation unit 110, and thereby generates a signal HBD. And, the variable HPF unit 130 sends the signal HBD that it has generated to the combination unit 140 (refer to FIG. 1).

Upon receipt of the signal HBD from the variable HPF unit 130, the combination unit 140 performs combination of the signal HBD and the compressed audio signal CAD sent from the compressed audio decompression device 200. During the combination, in the combination unit 140, the delay unit 141 delays the compressed audio signal CAD by just a time interval $T_{DL}$ that corresponds to the phase delay in the harmonic generation unit 110 and the variable HPF unit 130, and generates a signal DLD synchronized with the signal HBD. And, the delay unit 141 sends the signal DLD that it has generated to the multiplication unit $142_1$ (refer to FIG. 6).

Upon receipt of the signal DLD sent from the delay unit 141, the multiplication unit $142_1$ generates a signal MLD by multiplying the signal DLD by $K_1$. And, the multiplication unit $142_1$ sends the signal MLD that it has generated to the addition unit 143 (refer to FIG. 6).

On the other hand, the multiplication unit $142_2$ generates a signal MHD by multiplying the signal HBD by $K_2$. And, the multiplication unit $142_2$ sends the signal MHD that it has generated to the addition unit 143 (refer to FIG. 6).

Upon receipt of the signal MLD sent from the multiplication unit $142_1$ and of the signal MHD sent from the multiplication unit $142_2$, the addition unit 143 adds together the signal MLD and the signal MHD, and generates a signal HID upon which high frequency interpolation has been performed. And, the addition unit 143 sends the signal HID after performance of high frequency interpolation that it has generated to the audio sound output device 300 (refer to FIG. 6).

In other words, while synchronizing the signal HBD and the compressed audio signal CAD, the combination unit 140 combines the signal HBD and the compressed audio signal CAD by performing weighted addition at a mixing ratio at which high frequency interpolation can be appropriately performed. The signal HID after high frequency interpolation that has been generated as the result of the combination is then sent to the audio sound output device 300.

Upon receipt of the signal HID after high frequency interpolation that has been sent from the audio device 100 (more exactly, from the combination unit 140), the audio sound output device 300 outputs sound according to the signal HID after high frequency interpolation from the speaker SP. As a result, audio sound of high quality upon which high frequency interpolation corresponding to the bit rate of the compressed audio signal CAD has been appropriately performed is outputted from the audio sound output device 300.

As has been explained above, in the embodiment, during the high frequency interpolation, first, the harmonic generation unit 110 generates harmonics of the compressed audio signal CAD. In parallel with the generation of harmonics, the missing band estimation device 120 estimates the missing band in the compressed audio signal CAD.

During the missing band estimation, in the missing band estimation device 120, along with the high pass filter unit $121_1$ that has the cutoff frequency $F_{C1}$ extracting a high frequency component of the compressed audio signal CAD, also the high pass filter unit $121_2$ that has the cutoff frequency $F_{C2}$ (which $>F_{C1}$) extracts a high frequency component of the compressed audio signal CAD. Subsequently, in the missing band estimation device 120, the estimation unit 124 calculates the ratio R between the level of the difference signal SBD obtained by subtracting the signal $HPD_2$ outputted from the high pass filter unit $121_2$ (i.e. the second high pass filter unit) from the signal $HPD_1$ outputted from the high pass filter unit $121_1$ (i.e. the first high pass filter unit), and the level of the signal $HPD_2$. Note that, if the bit rate of the compressed audio signal CAD is different, then the filtering characteristics of the high pass filter units $121_1$ and $121_2$ are set so that the ratio R is different.

Next, on the basis of the ratio R that has been calculated, the estimation unit 124 estimates the missing band of the compressed audio signal CAD. And, the estimation unit 124 controls the high pass filtering processing by the variable HPF unit 130 by sending the cutoff frequency designator HPC that specifies the lower limit frequency of the estimated missing band to the variable HPF unit 130.

Based upon the control, the variable HPF unit 130 performs high pass filtering processing with the frequency specified by the cutoff frequency designator HPC as cutoff frequency upon the signal HMD sent from the harmonic generation unit 110, and thereby generates the signal HBD. And, the compressed audio signal CAD and the signal HBD are combined by the combination unit 140.

Thus according to the embodiment, with a simple configuration, it is possible to output audio sound of high quality upon which high frequency band interpolation has been appropriately performed.

Modifications of the Embodiment

The present invention is not to be considered as being limited to the embodiment described above; modifications of various types can be implemented thereto.

For example, in the embodiment, it was arranged to estimate the missing band of the compressed audio signal that is inputted on the basis of the ratio between the level of the difference signal obtained by subtracting the signal outputted from the second high pass filter unit from the signal outputted from the first high pass filter unit, and the level of the signal outputted from the second high pass filter unit. By contrast, it would be possible to arrange to estimate the frequency band of the compressed audio signal that is inputted on the basis of the ratio between the level of the signal outputted from the first high pass filter unit and the level of the signal outputted from the second high pass filter unit. And, it would be possible for the cutoff frequency designator that specifies the upper limit frequency for the estimated frequency band to be performed for the variable HPF unit.

Moreover, it would be possible to arrange to employ a high pass filter unit having filtering characteristics that are different from the characteristics of the high pass filter unit shown by way of example in the embodiment, provided that, when the bit rate of the compressed audio signal is different, the ratio between the level of the signal outputted from the first high pass filter unit and the level of the signal outputted from the second high pass filter unit is different.

Furthermore while, in the embodiment, it was arranged to apply the present invention to high frequency interpolation of a compressed audio signal, it would be possible to arrange to apply the present invention to high frequency interpolation of an audio signal that is a different type of signal from a compressed audio signal.

Note that it would be possible to arrange to perform all or a part of the processing of the embodiment by configuring the audio device of the embodiment as a computer that is provided with a DSP (Digital Signal Processor) or the like as a calculation means, and by executing a program that has been prepared in advance with that computer. It would be possible for the program to be acquired in the format of being recorded upon a transportable recording medium such as a CD-ROM, a DVD, or the like; or it would be possible to arrange for the program to be acquired by the method of transmission via a network such as the internet or the like.

The invention claimed is:

1. An audio device, comprising:

an input that receives an input audio signal;

a plurality of high pass filter units each having different cutoff frequencies from each other, each configured to receive said input audio signal and generate an output signal of a high frequency component of said input audio signal;

an estimation unit that estimates a high frequency band that corresponds to signal components in said input audio signal that are missing, based on a result of high pass filtering processing of said input audio signal by the plurality of high pass filter units;

a variable high pass filter unit that performs high pass filtering processing on harmonics of said input audio signal with a cutoff frequency determined based on an estimation result of said estimation unit; and a combination unit that combines said input audio signal and an output signal extracted by said variable high pass filter unit, wherein said high pass filter units include at least:

a first high pass filter unit, having a first cutoff frequency, that extracts a first high frequency component from said input audio signal, and a second high pass filter unit, having a second cutoff frequency higher than said first cutoff frequency, that extracts a second high frequency component from said input audio signal, said first cutoff frequency and said second cutoff frequency being set so that when a bit rate corresponding to said input audio signal becomes different, a ratio, between i) a level of a difference signal obtained by subtracting the output signal extracted by said second high pass filter unit from the output signal extracted by said first high pass filter unit and ii) a level of the output signal extracted by said second high pass filter unit, becomes different, and wherein said audio device generates an output for reproduction as sound generated by a speaker.

2. The audio device according to claim 1, further comprising:

a harmonic generation unit that generates harmonics of said input audio signal, and that supplies the generated harmonics to said variable high pass filter unit.

3. The audio device according to claim 1, further comprising:

a control unit that controls the cutoff frequency of said variable high pass filter unit, wherein said control unit controls the cutoff frequency of said variable high pass filter unit on the basis of a ratio between a level of a difference signal obtained by subtracting the output signal extracted by said second high pass filter unit from the output signal extracted by said first high pass filter unit, and the level of the output signal extracted by said second high pass filter unit.

4. A signal processing method carried out by an audio device equipped with an input that receives an input audio signal, an estimation unit, a variable high pass filter unit, a combination unit, and a plurality of high pass filter units each having cutoff frequencies different from each other, the signal processing method comprising the steps of:

an estimating step of said estimation unit estimating a high frequency band that corresponds to signal components in said input audio signal that are missing, based on a result of high pass filtering processing of said input audio signal by the plurality of high pass filter units;

a variable high pass filtering processing step of said variable high pass filter unit performing a high pass filtering processing on harmonics of said input audio signal with a cutoff frequency determined based on an estimation result of said estimation unit; and a combining step of said combination unit combining said input audio signal and an output signal extracted by said variable high pass filter unit to generate an output combinable with the input audio signal to generate an output for reproduction as sound generated by a speaker, wherein said high pass filter units include at least:

a first high pass filter unit, having a first cutoff frequency, that extracts a first high frequency component from said input audio signal, and a second high pass filter unit, having a second cutoff frequency higher than said first cutoff frequency, that extracts a second high frequency component from said input audio signal, said first cutoff frequency and said second cutoff frequency being set so that when a bit rate corresponding to said input audio signal becomes different, a ratio, between i) a level of a difference signal obtained by subtracting the output signal extracted by said second high pass filter unit from the output signal extracted by said first high pass filter unit and ii) a level of the output signal extracted by said second high pass filter unit, becomes different.

5. A non-transitory computer readable medium having recorded thereon a signal processing program that, when executed by a processor of a computer in an audio device, causes the computer to carry out the signal processing method according to claim 4.

6. The audio device according to claim 1, wherein said input audio signal is a compressed audio data signal.

* * * * *